United States Patent [19]

Baatz et al.

[11] Patent Number: 4,626,402

[45] Date of Patent: Dec. 2, 1986

[54] APPARATUS FOR THE STORAGE AND TRANSPORT OF RADIOACTIVE MATERIALS

[75] Inventors: Henning Baatz; Dieter Rittscher, both of Essen, Fed. Rep. of Germany

[73] Assignee: GNS Gesellschaft fur Nuklear-Service mbH, Essen, Fed. Rep. of Germany

[21] Appl. No.: 562,467

[22] Filed: Dec. 16, 1983

[30] Foreign Application Priority Data

Nov. 25, 1983 [DE] Fed. Rep. of Germany ..... 3342641

[51] Int. Cl.[4] ..... G21C 19/00

[52] U.S. Cl. ..... 376/272; 250/506.1; 250/507.1; 376/261

[58] Field of Search ..... 376/261, 272; 250/506.1, 507.1

[56] References Cited

U.S. PATENT DOCUMENTS

| | | | |
|---|---|---|---|
| 4,034,227 | 7/1977 | Soot | 376/272 |
| 4,209,420 | 6/1980 | Larker | 250/506.1 |
| 4,382,060 | 5/1983 | Holtz et al. | 250/506.1 X |
| 4,441,242 | 4/1984 | Hicken et al. | 376/272 X |
| 4,446,098 | 5/1984 | Pomaibo et al. | 376/272 X |
| 4,457,888 | 7/1984 | Vickrey, Jr. | 250/506.1 X |
| 4,474,727 | 10/1984 | Kmonk et al. | 376/272 |

OTHER PUBLICATIONS

*Type 304 Stainless Steel—Fuel,* Loria et al., Journal of Metals, Dec. 1980, pp. 10–17.

*Primary Examiner*—Peter A. Nelson

*Attorney, Agent, or Firm*—Karl F. Ross; Herbert Dubno

[57] ABSTRACT

Spherolitic cast iron or cast steel containers or nuclear steel elements are modified by replacement of the complex boron steel baskets with stainless steel or austenitic manganese steel lattices therefor and the lattices define vertical compartments in which the fuel rods removed from the elements are received in densest-packed relationship directly or via the intermediary of thin-walled metal sleeves.

8 Claims, 4 Drawing Figures

APPARATUS FOR THE STORAGE AND TRANSPORT OF RADIOACTIVE MATERIALS

CROSS REFERENCES TO RELATED APPLICATIONS

This application is related to the commonly assigned copending application Ser. No. 505,227 filed June 17, 1983 and Ser. No. 505,228 filed June 17, 1983. In addition, reference may be had to the following commonly owned copending applications in which we may also be named as inventors:

| Ser. No. | Filing Date |
|---|---|
| 483,244 | 8 April 1983 |
| 243,627 | 13 March 1981, now U.S. Pat. No. 4,528,454 |
| 243,562 | 13 March 1981, now U.S. Pat. No. 4,445,042 |
| 279,332 | 1 July 1981, now U.S. Pat. No. 4,447,733 |
| 396,883 | 9 July 1982 |
| 455,489 | 4 August 1983 |

Reference may also be had to the following U.S. patents (and the references therein cited) which bear on this subject matter and with which some of the above listed applications may have been copending:

U.S. Pat. No. 4,229,316
U.S. Pat. No. 4,235,739
U.S. Pat. No. 4,234,798
U.S. Pat. No. 4,272,683
U.S. Pat. No. 4,278,892
U.S. Pat. No. 4,288,698
U.S. Pat. No. 4,274,007

FIELD OF THE INVENTION

Our present invention relates to an apparatus for the transportation and storage of radioactive materials and especially the fuel rods of irradiated nuclear fuel elements for nuclear reactors.

BACKGROUND OF THE INVENTION

As will be apparent from the above-mentioned patents, copending applications and the literature cited in the files therein, it is known to provide receptacles or containers for storage and transportation of nuclear materials, such as nuclear fuel elements, which may be withdrawn from a nuclear reactor core during the changing of a fuel, the container being designed such that it absorbs at least most of the emissions from the radioactive materials therein.

Such containers can be fabricated from cast iron and especially nodular or spherolitic cast iron or from cast steel and generally employ a shielding cover which has a plug portion fitting into a socket portion of the receptacle to minimize the escape of radiation from the interior of the container through the cover or through a joint between the cover and the container. This joint may be stepped and provided with seals.

The container generally is provided with a receiving chamber or compartment adapted to accommodate a plurality of nuclear fuel elements and the compartment can also be provided with a basket with nests, pockets or the like adapted to receive the respective fuel elements and serving to enable the fuel elements to be inserted into the compartment.

The bottom of the container is also generally relatively thick to prevent escape of radiation therethrough and may be formed in one piece or unitarily with the container into which the shielding cover is inserted.

Other covers may also be applied for sealing and safety for redundancy purposes.

Such containers have been used for the storage of nuclear fuel elements as described, for example, in the publication *Brennelementzwischenlagerung in Transportbehaltern*—Fuel Element Temporary Storage in Transport Containers—of Preussen Electra dated February 1980. In this system, the fuel is not disassembled from the cans but rather is introduced in the form of fuel elements in the receiving shafts of the insert basket and is introduced with the latter into the compartment of the container. A given radiation shielding transport and storage container can only receive a certain number of the fuel elements and thus the number of fuel rods, i.e. the fuel bodies of these elements, which can be accommodated is likewise limited. In general, with cast iron or cast steel containers of the aforedescribed type, which have been used industrially, only sixteen irradiated fuel elements could be accommodated.

OBJECTS OF THE INVENTION

It is the principal object of the present invention to provide an improved transport and storage container for the purposes described whereby the storage capacity for the nuclear material of fuel elements can be increased.

Still another object of this invention is to reduce the storage and handling costs of radioactive materials, especially nuclear fuel elements, and to eliminate disadvantages of earlier storage and transport systems.

SUMMARY OF THE INVENTION

These objects and others which will become apparent hereinafter are attained, in accordance with the present invention, with a storage and transport system utilizing a container of the above described type wherein the fuel rods removed from the fuel elements are stored in a closest-packed relationship, i.e. a close-pack configuration, with the aid of an insert grid which is substituted, according to the invention, for the basket hitherto considered to be necessary. This grid or lattice can be composed of boron-free steel according to a feature of the invention, especially stainless steel or corrosion-resistant steel or an austenitic manganese steel.

The invention allows the transport and storage of a comparatively large amount of radioactive material from irradiated nuclear fuel elements in containers of a size or dimension which has previously been utilized for the direct storage and transport of such elements and indeed a vastly larger amount of the radioactive materials from such elements because the radioactive material is in the form of the fuel rods or bars which have been removed from the fuel elements or the casings or cans thereof.

The removal of the fuel rods or bars from the fuel elements allows them to be grouped in a closest-packed relationship, i.e. in one of the close-packed configurations and practically the most dense close-packed relationship that circular cross section rods can be held in, utilizing the insertion lattice which is formed with the columnar compartments within which the fuel rods are held in their closest-packed relationship.

While we can provide the closest-packed fuel rod assemblies in these compartments directly, it has been found to be advantageous to assemble the fuel rods into a volume corresponding to the volume of the respective compartment in a tightest possible packing and to hold them together by a thin-wall sleeve or envelope with which the pack can be easily manipulated and inserted into the compartments for eventual insertion with the other packs of rods in the lattice structure into the container.

In other words, the package formed by inserting the densely packed rods into the thin-wall envelope or sleeve is then easily inserted into the shaft or compartment of the insertion lattice and once the insertion lattice has had all of its compartments filled, it is lowered into the outwardly open, vertically elongated spherolitic (modular) cast iron or cast steel container.

One of the advantages of the present invention is that each of the vertically elongated compartments or respective sleeves can have comparatively thin walls and a diameter or width (maximum horizontal dimension) which is greater than that of a conventional fuel element so that in the space which was ordinarily required for a given number of such fuel elements, the number of fuel rods which can be stored and transported is vastly larger than the fuel rods corresponding to the cooler material within these elements, i.e. the number of fuel rods which are stored can be vastly greater than the number removed from the number of fuel elements which previously were intended to occupy a similar container.

Put otherwise, while storage containers of spherolitic cast iron or cast steel, as described in the aforementioned applications and patents, have been used for the storage of irradiated nuclear fuel elements heretofore and such elements comprised a casing or can containing nuclear fuel rods so that the containers ultimately could be considered as storage and shielding containers for the nuclear material of such rods, when the elements as a whole were so stored, the number of rods enclosed in a given container was somewhat limited.

Utilizing the close-packed system with the grid or lattice of the invention, the space within an identical container can be filled according to the invention with a much greater number of fuel rods and thus the storage of radioactive fuel element material is improved.

Less obvious advantages of the present invention include those discovered when the close-packed arrangement of the fuel rods was used. The system of the invention has been found to eliminate practically entirely the convective dissipation of heat from the contents of the container to the wall hereof.

With conventional packaging of fuel elements wherein, as with the case of the instant invention, the interstices of the container are filled with helium gas, practically all of the heat transfer was by convection. Thus one normally would expect the instant invention to result in a reduction of heat transfer.

Surprisingly, however, the close-packed relationship means that practically every rod is in contact with a number of adjoining rods and/or in contact with a heat-conductive wall, e.g. of the metal sleeves or envelopes or of a container or of the lattice, so that the heat transfer by convection is greatly increased over the systems in which the fuel elements were stored.

Indeed, this improved heat transfer can approach twice the heat transfer experienced with fuel element packaging in similar containers. Presumably, this is a result of the fact that the innermost rods which are the hottest are in contact with twice as many rods because of the close-packed system than might otherwise be the case and hence the conductive dissipation of heat is at least twice as great.

While the temperature evolution in earlier containers limited the amount of radioactive material which could be safely stored therein, we have found, surprisingly, that the increased heat dissipation permits, for a given maximum temperature within the container, practically twice as much radioactive material and hence twice as many nuclear fuel rods to be stored therein.

Even when the fuel rods are enclosed in sleeves, the container can hold more than twice the number of fuel rods and hence nuclear material stored earlier in the form of fuel elements because these sleeves are comparatively thin-walled and have geometries which correspond to the shaft-like compartments of the lattice and the lattice can have a cross section corresponding to the chamber of the containers whereby the container is more completely filled and the differences between the geometry of the fuel elements and the container chamber with the resulting dead spaces do not play any role. The thin-wall sleeves and lattices of the instant invention also greatly facilitate the filling, the handling and the emptying of the containers.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
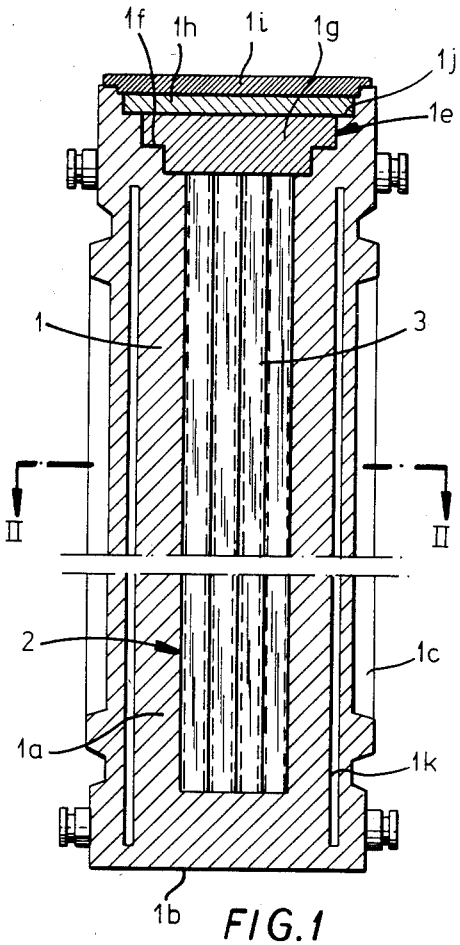
FIG. 1 is a vertical cross section in somewhat diagrammatic form through a container for packaging nuclear fuel element rods according to the present invention.
Figure 3:
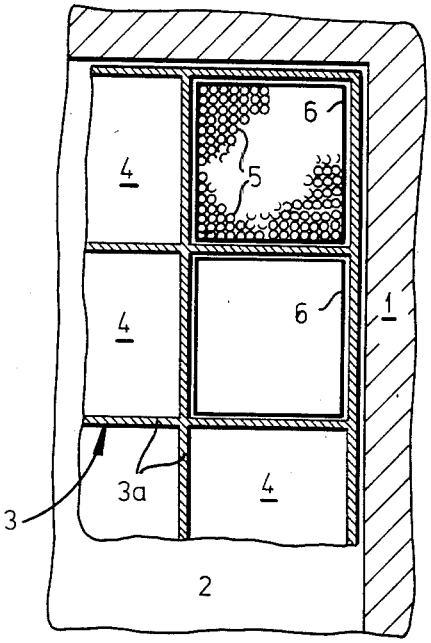
FIG. 3 is a detail view drawn to an enlarged scale of the region III of FIG. 2.
Figure 2:
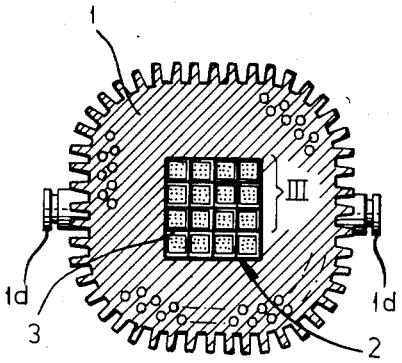
FIG. 2 is a section along the line II—II of FIG. 1.

The container shown in FIGS. 1 through 3 basically utilizes the receptacle structure of the aforementioned copending applications and patents and, more specifically, comprises a container 1 which can be comprised of spherolitic cast iron or cast steel, is formed unitarily with a compartment 2 which is upwardly open and defined between vertical walls 1*a* and a bottom 1*b* unitary therewith, all comprised of the spherolitic cast iron for example, and cast in one piece therewith.

The vertical walls 1*a* can be provided externally with fins 1*c* to assist in the dissipation of heat and lateral projections 1*d* to enable the container to be handled by a crane or other hoisting machine for manipulating the filled or empty container. The filled container is provided at its upper end with a seat 1*e* which can have the configuration of a stepped socket and has, for example, a shoulder 1*f* against which a flange of a shielding cover 1*g* can rest. O-ring seals or welded lip seals can be provided between this cover and the container as described in the references made of record above.

A first safety cover 1*h* can directly overlie the cover 1*g* and can sealingly engage a further shoulder 1*j* while the outer cover 1*i* can overlie the cover 1*h* and also can be sealed to the container. The covers 1*i* and 1*h* may define with one another and the cover 1*h* may define with the cover 1*g* respective monitoring spaces which can contain a fluid or can be evacuated and which can be monitored by appropriate fittings to enable the detection of escape of radioactive material or loss of seal of the container.

Thus far we have described a structure conventional in the art and the container may also include vertical bores 1*k* receiving material having a high neutron cross section, e.g. paraffin, to increase the shielding capabilities of the container.

In the past a container of this type was utilized for the transport and storage of nuclear fuel element, i.e. an elongated structure consisting of the nuclear fuel and a can or other casing and which, after irradiation in the core of the nuclear reactor, was inserted into the container for transport and storage.

In the system of the invention, however, an insertion basket or lattice 3 is provided which consists of mutually orthogonal walls 3*a* which extend vertically and define compartments 4. Where such baskets were utilized for intact fuel elements, a respective fuel element was introduced into each compartment.

However, as can be seen from FIG. 3, especially, with the present invention, the column, shaft or compartment 4 is utilized to receive a pack of nuclear fuel rods 5 which are enclosed in a thin-wall, e.g. foil, sleeve 6 and which are in a closest-packed relationship. While the sleeve 6 can correspond geometrically to a fuel element, it is of extremely thin-wall construction and can be of aluminum or tin foil construction so that within the space enclosed by the sleeve 6, a substantially larger number of fuel rods removed from respective fuel elements, in the dense packed configuration shown, can be accommodated.

The package 5, 6 is thus initially formed and inserted as a unit into the respective compartment 4 and when all of the compartments 4 are filled, the lattice 3 can be inserted into the container.

The basket 3 need not be an expensive boron-steel basket of complex configuration as hitherto has been found necessary when intact fuel elements were packaged but can be a simple insertion lattice as shown and composed of relatively inexpensive stainless steel or austenitic manganese steel and can even be a boron-free steel.

The sleeve 6 and each compartment 4 can have horizontal dimensions or diameters greater than that of the fuel element for which the container may have been originally designed and hence in the total cross section of the compartment 2 a substantially larger number of fuel rods 5 can be accommodated than would be the case if these rods remain in their fuel elements and the fuel elements were introduced into the container.

Figure 4:
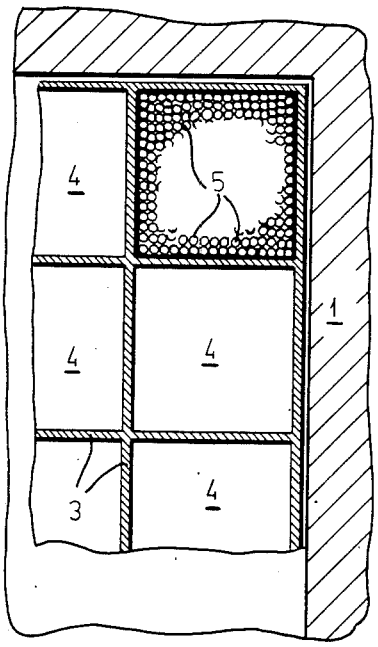
FIG. 4 is a view similar to FIG. 3 representing another embodiment of this invention.

In the embodiment of FIG. 4 it can be seen that the closest-packed rods 5 are directly received in the compartment 4 and hence the sleeves 6 are omitted thereby increasing the number of fuel rods 5 in the cross section of the compartment 2 still further. In both embodiments, lattice 3 comprises 16 compartments 4 of square cross section and is relatively thin-walled so that there is minimum spacing between sleeves of adjoining compartments or between the packed fuel rods of the adjoining compartments.

We claim:

1. In a system for the transport and storage of the radioactive material contained in the form of fuel rods of nuclear fuel elements irradiated in the core of a nuclear reactor, wherein said elements can be accommodated in an upwardly open chamber of a container composed of a cast iron or steel and receiving at least one sliding cover, the improvement wherein:

said chamber is provided with a grid-shaped metal lattice defining vertically extending compartments, and said fuel rods after removal from said elements are disposed in said compartments in a closest-packed configuration wherein said fuel rods have line contact along their length with adjacent fuel rods with the closest possible packing that minimizes free-space.

2. The improvement defined in claim 1 wherein the fuel rods in each compartment are enclosed in a thin-wall sleeve.

3. The improvement defined in claim 1 wherein said material is composed of boron-free steel.

4. The improvement defined in claim 3 wherein said lattice is composed of a stainless steel or an austenitic manganese steel.

5. The improvement defined in claim 2 wherein said material is composed of boron-free steel.

6. The improvement defined in claim 5 wherein said lattice is composed of a stainless steel or an austenitic manganese steel.

7. The improvement defined in claim 2 wherein said sleeve and the respective compartment have diameters greater than that of said elements and the portions of the lattice between said sleeves are of correspondingly reduced thickness.

8. The improvement defined in claim 6 wherein said sleeve and the respective compartment have diameters greater than that of said elements and the portions of the lattice between said sleeves are of correspondingly reduced thickness.

* * * * *